United States Patent [19]

Otake et al.

[11] Patent Number: 4,551,150

[45] Date of Patent: Nov. 5, 1985

[54] METHOD FOR DYEING CELLULOSE FIBER MATERIAL USING FIBER-REACTIVE DISAZO DYE AND FINISHING THE SAME

[75] Inventors: Katsumasa Otake, Nara; Takashi Ikeda, Yao; Takashi Omura, Ashiya; Kunihiko Imada, Sakai, all of Japan

[73] Assignee: Sumitomo Chemical Company, Limited, Osaka, Japan

[21] Appl. No.: 617,032

[22] Filed: Jun. 4, 1984

[30] Foreign Application Priority Data

Jun. 7, 1983 [JP] Japan ..... 58-102208

[51] Int. Cl.[4] ..... D06M 15/16; D06P 3/66; D06P 1/38

[52] U.S. Cl. ..... 8/496; 8/541; 8/549; 8/918

[58] Field of Search ..... 8/496, 541, 543, 549

[56] References Cited

U.S. PATENT DOCUMENTS 4,412,948 11/1983 Omura et al. ..... 260/153

FOREIGN PATENT DOCUMENTS 87113 8/1983 European Pat. Off. .
56-128380 10/1981 Japan .
1320921 6/1973 United Kingdom .
2034343 6/1980 United Kingdom .

*Primary Examiner*—A. Lionel Clingman
*Attorney, Agent, or Firm*—Stevens, Davis, Miller & Mosher

[57] ABSTRACT

Cellulose fiber materials are dyed with a dye represented by a free acid of the formula, $$(Q_1-W_1)_m-\overset{SO_3H}{\overset{|}{A_1}}-N=N-D-N=N-\overset{SO_3H}{\overset{|}{A_2}}-(W_2-Q_2)_n$$

wherein $W_1$ and $W_2$ are independently a direct linkage or a bridging group, $Q_1$ and $Q_2$ are independently a fiber-reactive group, $A_1$ and $A_2$ are independently a phenylene or naphthylene group unsubstituted or substituted, D is a residue of 1-amino-8-naphthol mono- or di-sulfonic acid, m and n are independently 0, 1 or 2, provided that they satisfy the formula, $0<m+n\leqq 2$, and each sulfo group appended to $A_1$ and $A_2$ is located at the carbon atom adjacent to the azo group, and then finished with a finishing agent capable of bonding with cellulose through a bridge formation, thereby obtaining dyed and finished products excellent in anticrease and shrinkproofing properties as well as various fastness properties such as light fastness, perspiration light fastness and chlorine fastness without any color change.

7 Claims, No Drawings

METHOD FOR DYEING CELLULOSE FIBER MATERIAL USING FIBER-REACTIVE DISAZO DYE AND FINISHING THE SAME

The present invention relates to a method for obtaining cellulose fiber materials dyed and finished. More specifically, the invention relates to a method for obtaining cellulose fiber materials both dyed in a blue to black color and finished with a fiber-reactive finishing agent to have superior fastness properties.

For dyeing cellulose fiber materials in a blue to black color, there have heretofore been used direct dyes, sulfur dyes, vat dyes, naphthol dyes, reactive dyes and the like. Recently, however, reactive dyes have been widely used therefor, because the direct dyes, sulfur dyes and naphthol dyes have problems in fastness, so that they should be used only in a limited field, the sulfur dyes, vat dyes and naphthol dyes require troublesome procedures for the dyeing, and moreover the vat dyes can give favorable fastness but are expensive for the dyeing.

As the reactive dyes usable for dyeing the fiber materials in a blue to black color, there are known C.I. Reactive Black 5, C.I. Reactive Blue 184 and the like, which are fiber-reactive disazo dyes having 1-amino-8-3,6-disulfonic acid as a divalent coupling component as disclosed in German Patent No. 2417253 and German Patent Publication No. 1644198.These reactive dyes have now been extensively used because of their economical advantages resulting from the fact that they can exhibit favorable dyeability even by a conventional dyeing method applied industrially and give a dyed product having fastness properties meeting with needs usually required. However, these dyes have drawbacks common to all such that when products dyed with such reactive dyes are finished with a cellulose-reactive finishing agent such as N-methylol compounds, the color shade markedly changes and fastness properties such as light fastness markedly deteriorates, as compared with those before the finishing.

The finishing with such cellulose-reactive finishing agent is practically useful for improving the properties of cellulose fibers, such as shrink resistance, crease resistance, wash and wear property, durable press property and the like, and therefore it becomes very important to make the color shade and fastness unchanged even after such finishing. For such purpose, vat dyes have heretofore been used, but now increasingly required to be replaced with reactive dyes because of the reasons described above. Thus, it is anxious to find a method for obtaining dyed fiber materials unsusceptible to such finishing.

The present inventors have undertaken extensive studies to find a method for obtaining products of cellulose fiber materials, which are dyed with a reactive dye and finished, hard to change the color shade and excellent in fastness properties, and as a result found that the object can be accomplished by dyeing cellulose fiber materials with a fiber-reactive disazo dye having sulfo groups located at each carbon atom adjacent to both azo groups, followed by a finishing with a fiber-reactive finishing agent.

The present invention provides a method for producing dyed and finished products of cellulose fiber materials, which comprises dyeing cellulose fiber materials with a dye represented by a free acid of the following formula (I),

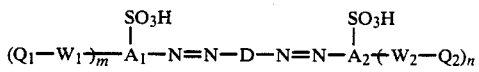

(I)

wherein $W_1$ and $W_2$ are independently a direct linkage or a bridging group, $Q_1$ and $Q_2$ are independently a fiber-reactive group, $A_1$ and $A_2$ are independently a phenylene or naphthylene group unsubstituted or substituted, D is a residue of 1-amino-8-naphthol mono- or di-sulfonic acid, m and n are independently 0, 1 or 2, provided that they satisfy the formula, $0<m+n\leqq 2$, and each sulfo group appended to $A_1$ and $A_2$ is located at the carbon atom adjacent to the azo group, and then finishing the dyed fiber materials with a finishing agent capable of bonding with cellulose through a bridge formation.

The dye of the formula (I) usable in the present invention has one or more fiber-reactive groups which may be the same or different from each other. These fiber-reactive groups are those disclosed in, for example, "The Chemistry of Synthetic Dyes", Volume VI, Reactive Dyes, by Venkataraman. Of these, preferred are halopyrimidinyl, halotriazinyl and vinylsulfonyl type reactive groups. More specifically, as the groups represented by the formulas $-W_1-Q_1$ and $-W_2-Q_2$, in the formula (I), the followings are particularly preferred.

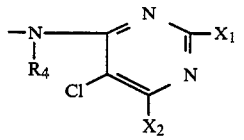

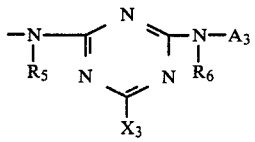

$-W-Y$ wherein $R_4$, $R_5$ and $R_6$ are independently a hydrogen atom or a lower alkyl group, $X_1$ is a fluorine or chlorine atom or a methylsulfonyl group, $X_2$ is a fluorine or chlorine atom or a methyl group, $X_3$ is a fluorine or chlorine atom, W is a direct linkage, a methylene group or a group of

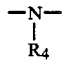

(in which $R_4$ is as defined above), Y is a group of $-SO_2CH{=}CH_2$ or $-SO_2CH_2CH_2Z$ (in which Z is a group capable of being split by the action of an alkali), $A_3$ is a hydrogen atom, an alkyl, phenyl or naphthyl group unsubstituted or substituted, or group of $-A_4-Y$ (in which Y is as defined above and $A_4$ is a phenylene or naphthylene group unsubstituted or substituted).

Among the residue represented by D, preferred is a 1-amino-8-naphthol-3,6-disulfonic acid residue.

In the dye of the formula (I) usable in the present invention, the dye body is characteristic, and the fiber-reactive group and the bridging group between the dye body and the fiber-reactive group are not particularly limited. Among the dyes of the formula (I), preferred is a dye represented by a free acid of the following formula (III),

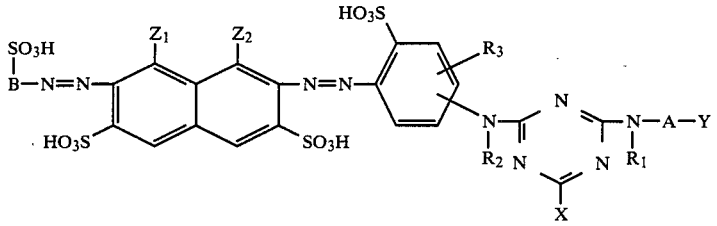

(III)

wherein A is a phenylene group unsubstituted or substituted with one or two substituents selected from methyl, ethyl, methoxy, ethoxy, chlorine, bromine and sulfo, or a naphthylene group unsubstituted or substituted with one sulfo, $R_1$ and $R_2$ are independently a hydrogen atom or a $C_1$ to $C_4$ alkyl group unsubstituted or substituted with hydroxy, cyano, alkoxy, halogen, carboxy, carbamoyl, alkoxycarbonyl, sulfo or sulfamoyl, $R_3$ is a hydrogen atom or a methyl or sulfo group, B is a phenylene or naphthylene group unsubstituted or substituted with one or two substituents selected from chlorine, bromine, fluorine, carboxy, methoxy, ethoxy, methyl, ethyl, nitro and sulfo, the sulfo group appended to B is located at the carbon atom adjacent to the azo group, any one of $Z_1$ and $Z_2$ is a hydroxy group, and the other is an amino group, X is a fluorine or chlorine atom, and Y is a group of $-SO_2CH=CH_2$ or $-SO_2CH_2CH_2Z$ (in which Z is as defined above).

The dye of the formula (III) is a so-called difunctional reactive dye having two fiber-reactive groups on one of two diazo components. Of these dyes (III), preferred are those having a hydroxy group as $Z_1$, an amino group as $Z_2$, and hydrogen atoms as $R_2$ and $R_3$, respectively.

The dyes of the formula (I) are disclosed, for example, in Published Unexamined Japanese Patent Applications 9483/1981, 128380/1981 and the like, and can be produced in a manner known per se as disclosed in the Patent Applications.

Generally speaking, the dye of the formula (I) can be produced by reacting a compound represented by the following formula (IV), $$H-D-H \qquad (IV)$$

wherein D is as defined above, with any one of diazonium compounds derived from each compound represented by the following formula (V-1) or (V-2), $$(Q_1-W_1)_m-\overset{SO_3H}{\overset{|}{A_1}}-NH_2 \qquad (V\text{-}1)$$

$$H_2N-\overset{SO_3H}{\overset{|}{A_2}}-(W_2-Q_2)_n \qquad (V\text{-}2)$$

wherein $A_1$, $A_2$, $Q_1$, $Q_2$, $W_1$, $W_2$, m and n are as defined above, to obtain a corresponding monoazo compound, followed by the reaction with the remaining one.

The finishing agent usable in the present invention includes those capable of bonding with cellulose fibers through a bridge formation, more specifically capable of being impregnated into the fibers to react with them through a bridge formation, thereby improving the physical properties of the fibers.

Examples of the finishing agents are N-methylol compounds, aldehyde compounds of the formula, R—CHO, in which R is a hydrogen atom or an alkyl, cycloalkyl or haloalkyl group, acetal compounds of the formula, $R'-CH(OR'')_2$, in which R' is a hydrogen atom or an alkyl, cycloalkyl or haloalkyl group, and R'' is a hydrogen atom or an alkyl group, epoxy compounds, active vinyl compounds, aziridinyl compounds, polycarboxylic acid compounds, acylhalide compounds, isocyanate compounds, quaternary ammonium compounds and the like. These may be used each alone or in a mixture of two or more. Of these, preferred are N-methylol compounds including condensation type compounds such as dimethylolurea and methylated trimethylolmelamine, and cellulose-reactive type compounds such as dimethylol ethyleneurea, dimethylol alkylenetriazones, methylated methyloluron, hexamethylolmelamine, dimethylol propyleneurea, dimethylol hydroxyethyleneurea, tetramethylol acetylenediurea, dimethylolated 4-methoxy-5-dimethylpropyleneurea, dimethylol alkylcarbamates and derivatives thereof.

A catalyst usable in the present invention for the bridge formation reaction between the finishing agent and cellulose includes acids, acid salts and latent acid catalysts capable of liberating acids under heating conditions. Examples thereof are ammonium salts, alkanolamine salts, inorganic metal salts, which are commercially available as the catalysts for resin-finishing.

Cellulose fiber materials usable in the present invention include natural and regenerated cellulose fiber materials such as cotton, hemp, linen, jute, viscose rayon, artificial rayon and the like.

In the present invention, the dyeing of cellulose fiber materials with the dye of the formula (I) can be carried by an exhaustion dyeing, cold batch dyeing or continuous dyeing method or a printing method.

The exhaustion dyeing can be carried out in a conventional manner using a dye bath containing an acid binding agent such as sodium carbonate, trisodium phosphate, sodium hydroxide and the like, and an inorganic salt such as sodium sulfate, sodium chloride and the like.

The cold batch dyeing can be carried out in a manner such that the fibers are padded at ambient temperature with a liquor containing at least one acid binding agent such as sodium hydroxide, sodium silicate, sodium carbonate, sodium phosphate, sodium aluminate and the like, and if desired, an inorganic salt such as sodium sulfate, sodium chloride and the like along with or without a dissolving agent such as urea, a penetrant and the like, and then allowing the fibers padded to stand for a fixed period of time.

The continuous dyeing can be carried out in a conventional manner such as a pad-steam method wherein the fibers are padded with a dye liquor and then with a liquor of an acid binding agent such as sodium hydroxide, sodium silicate, sodium carbonate, sodium phosphate and the like, followed by a heat treatment with steam, an alkali shock method wherein the fibers padded with the dye liquor are treated with a hot liquor of the acid binding agent, and a baking method wherein the fibers are padded with a liquor containing both the dye and the acid binding agent such as sodium hydrogencarbonate, sodium carbonate and the like, followed by a dry-heating.

The printing can be carried out by applying to the fibers a printing paste containing a sizing agent or emulsified sizing agent such as sodium alginate, starch ether and the like, an acid binding agent such as sodium carbonate, sodium hydrogencarbonate, sodium hydroxide, trisodium phosphate, sodium trichloroacetate and the like, and if desired a printing auxiliary agent such as urea, sufactant and the like, and then heating the fibers in the presence or absence of steam.

The cellulose fiber materials dyed with the dye of the formula (I) in any manner as described above are then finished in a conventional manner applied industrially. For example, the dyed fibers are impregnated with a liquor containing both the finishing agent and the catalyst, press-squeezed up to 40 to 120% in pick-up, dried and then heat-treated, thereby completing the bridge formation reaction to obtain resin-finishing effects. The finished fibers may be or may not be rinsed, and then dried to obtain a final product.

The finishing in accordance with the present invention may be accompanied with other finishings such as softening, water and oil repellenting, soil releasing, sanitary finishing, flame retarding and the like, which have been usually applied for improving the properties of cellulose fiber materials.

The method of the present invention can solve the problems such that products dyed with C.I. Reactive Blue 184, C.I. Reactive Black 5 and other conventional disazo reactive dyes are easy to change their color shade and deteriorate fastness properties such as light fastness, hot pressing fastness, steam set fastness and the like, when finished in a conventional manner, and therefore vat dyes, sulfur dyes and naphthol dyes have been unavoidably used with various drawbacks as mentioned before. Thus, the present invention can be said to be markedly advantageous from industrial point of view.

The present invention is illustrated in more detail with reference to the following Examples, which are only illustrative and not intended to limit the scope of the present invention. In Examples, parts are by weight.

EXAMPLE 1

Into a dye bath containing a dye (0.3 part) represented by a free acid of the formula (1),

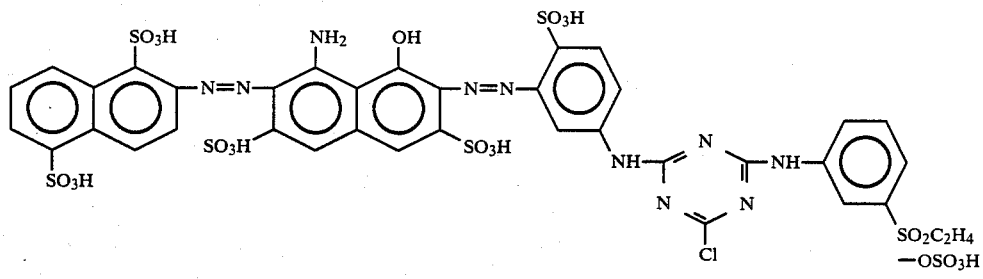

(1)

sodium sulfate (30 parts) and water (200 parts) was dipped cotton broad cloth (10 parts), and the bath was heated to 60° C. Sodium carbonate (4 parts) was added to the bath, and the dyeing was continued for 1 hour at that temperature. Thereafter, the cloth was rinsed with water and soaped to obtain a dyed product of a deep blue color.

The dyed product was dipped into a bath (100 parts) containing a urea-melamine-formaldehyde precondensate (Sumitex Resin ULW, a product of Sumitomo Chemical Co., 20 parts) and an organic amine salt catalyst (Sumitex Accelerator ACX, a product of Sumitomo Chemical Co., 1 part), and then press-squeezed to 60% in pick-up. The product thus treated was dried for 1 minute at 120° C. and then subjected to curing for 3 minutes at 150° C. to obtain a finished product of a deep blue color having superior anticrease and shrinkproofing properties. The product was found to be little in a color change and excellent in fastness properties such as steam set fastness, perspiration light fastness and chlorine fastness.

COMPARATIVE EXAMPLE 1

Dyeing was carried out in a manner similar to that of Example 1, provided that a dye represented by a free acid of the formula (2),

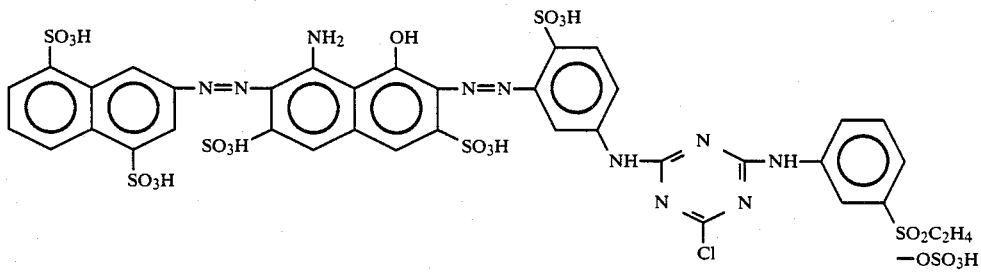

(2)

was used, obtaining a dyed product of a deep blue color.

The dyed product was subjected to resin finishing in the same manner as in Example 1. As a result, the final product markedly changed in the color shade into a reddish color, and was inferior in fastness properties such as light fastness and steam set fastness. The fastness properties before the resin-finishing had been found to be favorable.

Results obtained in Example 1 and Comparative Example 1 are summarized as follows.

| | | Color change | Fastness | |
|---|---|---|---|---|
| | | | Light | Steam set |
| Example 1 | Before finishing | Standard | 4–5 | 4–5 |
| | After finishing | Similar | 4–5 | 4–5 |
| Comparative Example 1 | Before finishing | Standard | 4–5 | 4–5 |
| | After finishing | Markedly reddish | 2–3 | 1 |

Note:
Color change: Judged by comparing the color after the finishing with that before the finishing as a standard.
Light fastness: Measured according to JIS L-0842.
Steam set fastness: Final product was subjected to steam set for 20 minutes at 130° C., and then compared in the color with the color before the steam set using a grey scale for assessing change in color (JIS L-0810).

Reference Example (Synthesis of the dye used in Example 1)

A 35% aqueous solution (5.1 parts) of sodium nitrite was introduced at 0° to 5° C. into a mixture of 2-aminonaphthalene-1,5-disulfonic acid (7.5 parts), water (160 parts), ice (40 parts) and concentrated hydrochloric acid (3.7 parts) to effect diazotization. Excess nitrous acid was decomposed to obtain a diazonium liquor.

A neutral solution of 1-amino-8-hydroxynaphthalene3,6-disulfonic acid (7.73 parts) was added to the diazonium liquor at 0° to 10° C. taking over one hour, and the coupling reaction was continued at pH 1.0 to 2.0. After stirring for several hours, the mixture was neutralized adjusting the pH to 7, and then mixed with sodium chloride at 30° to 35° C. to obtain a monoazo dye.

On the other hand, a mixture of cyanuric chloride (4.61 parts) and m-phenylenediaminesulfonic acid (4.70 parts) in an aqueous solution (50 parts) of a surfactant was kept for 1–2 hours at a temperature of 0° to 5° C. and a pH 1.5 to 3.0, to complete a first condensation. Successively, 1-aminobenzene-3-β-sulfatoethylsulfone (6.95 parts) was added to the first condensation mixture, and the resulting mixture was stirred over night at 25° to 30° C. while controlling the pH within a range of 5 to 5.5, to complete a second condensation.

To this second condensation mixture were added ice (50 parts), concentrated hydrochloric acid (7.1 parts), and then a 35% aqueous solution (5.3 parts) of sodium nitrite to effect diazotization. The resulting diazonium liquor after decomposing excess nitrous acid present therein was introduced at 5° to 10° C. into the above monoazo dye-containing suspension which had been made alkaline with sodium hydrogencarbonate, and the mixture was stirred for 1 to 2 hours to complete coupling reaction. The reaction mixture was adjusted to a pH of 5.5 to 6.0 with a diluted sulfuric acid and a temperature of 50° to 55° C., and then mixed with sodium chloride. The crystals precipitated were collected on a filter, washed and then dried at 60° C. to obtain the dye (1) (38.5 parts). (λ max 593 nm, measured in a water solvent, this measurement was also applied to those described below.)

EXAMPLES 2 to 7

The dyeing of Example 1 was repeated with the exception using each of the dyes (3) to (8) as shown in Table to obtain each dyed product of a deep blue color.

The dyed product was dipped in a bath (100 parts) containing methylated methyloluron (Sumitex Resin 800 K, a product of Sumitomo Chemical Co., 10 parts) and an organic amine salt catalyst (Sumitex Accelerator ACX, the same as in Example 1, 1 part), and press-squeezed up to 65% in pick up. The product thus treated was dried for 1 minute at 120° C. and then subjected to curing for 2 minutes at 160° C. to obtain a finished product of a deep blue color having superior anticrease and shrinkproofing properties. The product was found to be little in a color change and excellent in fastness properties such as light fastness, hot pressing fastness, steam set fastness, perspiration light fastness and chlorine fastness.

In the following Table, there are given each starting compounds used for the preparation of the dye used above in columns A, B, C and D, which correspond to 1 aminobenzene-3-β-sulfatoethylsulfone, cyanuric chloride, 2-aminonaphthalene-1,5-disulfonic acid and 1-amino-8-hydroxynaphthalene-3,6-disulfonic acid used in Reference Example, respectively.

Each dye obtained in a manner similar to that of Reference Example is characterized by a λmax value shown in column E.

TABLE

| No. | A | B | C | D | E λmax (nm) |
|---|---|---|---|---|---|
| (3) | 1-Aminobenzene-4-β-sulfatoethylsulfone | Cyanuric chloride | 2-Aminonaphthalene-1,5-disulfonic acid | 1-Amino-8-hydroxy-naphthalene-3,6-disulfonic acid | 593 |
| (4) | 1-Amino-4-methoxy-benzene-3-β-sulfato-ethylsulfone | Cyanuric chloride | 2-Aminonaphthalene-1,5-disulfonic acid | 1-Amino-8-hydroxy-naphthalene-3,6-disulfonic acid | 593 |
| (5) | 1-(N—Methylamino)-benzene-3-β-sulfato-ethylsulfone | Cyanuric chloride | 2-Aminonaphthalene-1,5-disulfonic acid | 1-Amino-8-hydroxy-naphthalene-3,6-disulfonic acid | 593 |
| (6) | 1-Aminobenzene-3-β-sulfatoethyl-sulfone | Cyanuric fluoride | 2-Aminonaphthalene-1,5-disulfonic acid | 1-Amino-8-hydroxy-naphthalene-3,6-disulfonic acid | 593 |
| (7) | 1-Aminobenzene-3-β-sulfatoethyl-sulfone | Cyanuric chloride | 2-Aminonaphthalene-1-sulfonic acid | 1-Amino-8-hydroxy-naphthalene-3,6-disulfonic acid | 597 |
| (8) | 1-Aminobenzene-3-β-sulfatoethyl-sulfone | Cyanuric chloride | 2-Aminonaphthalene-1,5-disulfonic acid | 1-Amino-8-hydroxy-naphthalene-4-sulfonic acid | 587 |

EXAMPLE 8

Cotton broad cloth (10 parts) was dipped into a dye bath containing a dye (0.3 part) represented by a free acid of the formula (9),

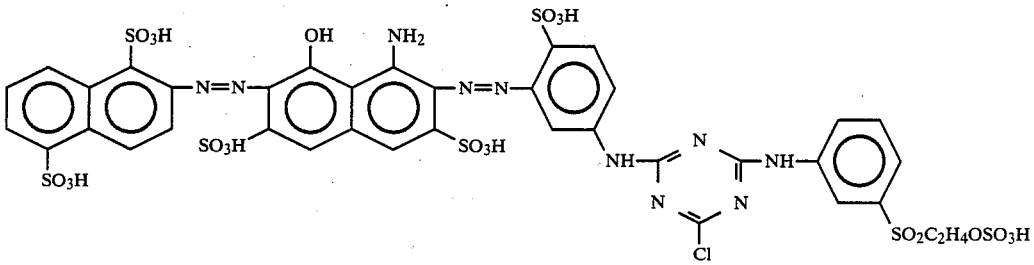

(9)

sodium sulfate (20 parts) and water (200 parts), and the bath was heated to 60° C. then sodium carbonate (4 parts) was added to the bath, and the dyeing was continued for 1 hour at that temperature. Thereafter, the cloth was rinsed with water and soaped to obtain a dyed product of a deep blue color.

The dyed product was dipped into a bath (100 parts) containing methylated trimethylol melamine (Sumitex Resin MK, a product of Sumitomo Chemical Co., 7 parts) and an organic amine salt catalyst (Sumitex Accelerator ACX, the same as in Example 1, 0.7 part), and press-squeezed to 60% in pick up. The product thus treated was dried for 1 minute at 120° C. and cured for 2 minutes at 160° C. to obtain a finished product of a deep blue color having excellent anticrease and shrinkproofing properties. The product was found to be little in a color change and excellent in various fastness properties such as light fastness, hot pressing fastness, steam set fastness, perspiration light fastness and chlorine fastness.

EXAMPLE 9

A dye (65 parts) represented by a free acid of the formula (10),

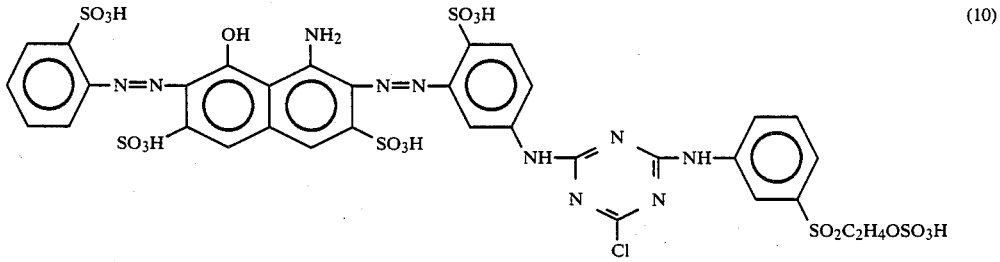

(10)

was dissolved in hot water, and the solution was cooled to 25° C. To this solution were added a 32.5% sodium hydroxide solution (15 parts), 50° Be' water glass (150 parts), and then water to make the whole 1000 parts. Cotton cloth was padded with the padding liquor prepared above, and the cloth padded was batched up, tightly wrapped with a polyethylene film and allowed to stand for 20 hours in a room kept at 20° C. Thereafter, the cloth was rinsed with water and soaped to obtain a dyed product of a deep blue color.

The dyed product was dipped in a bath (1000 parts) containing dimethylol dihydroxyethyleneurea (Sumitex Resin NS-11, a product of Sumitomo Chemical Co., 100 parts) and an inorganic metal salt catalyst (Sumitex Accelerator KX, a product of Sumitomo Chemical Co., 20 parts), and then press-squeezed to 60% in pick-up. The product thus treated was dried for 1 minute at 120° C. and cured for 3 minutes at 150° C. to obtain a finished product of a deep blue color having excellent anticrease, shrinkproofing and permanent press properties. The product was found to be little in a color change and excellent in various fastness properties such as light fastness, hot pressing fastness, steam set fastness and chlorine fastness.

EXAMPLE 10

Cotton broad cloth (10 parts) was dipped into a bath containing a dye (0.3 part) represented by a free acid of the formula (11),

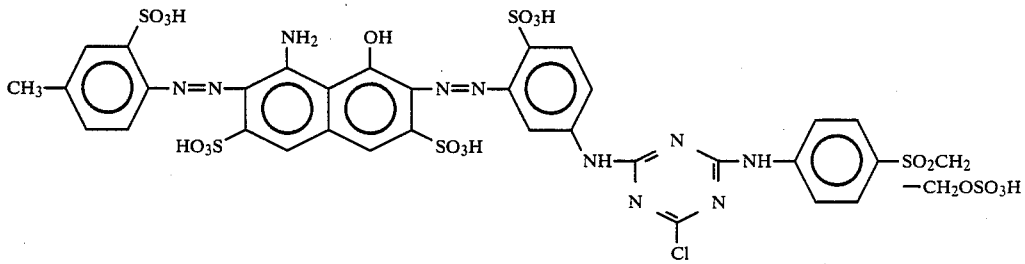

(11)

sodium sulfate (20 parts) and water (200 parts), and the bath was heated to 60° C. Then, sodium carbonate (4 parts) was added to the bath, and the dyeing was continued for 60 minutes at that temperature. Thereafter, the cloth was rinsed with water and soaped to obtain a dyed product of a deep blue color.

The dyed product was dipped into a bath (100 parts) containing dimethylolethyleneurea (Sumitex Resin 901, a product of Sumitomo Chemical Co., 10 parts) and a specific metal salt catalyst (Sumitex Accelerator X-80, 2 parts), and press-squeezed to 60% in pick-up. The product thus treated was dried for 1 minute at 120° C., and then cured for 3 minutes at 150° C. to obtain a finished product of a deep blue color having superior anticrease and shrinkproofing properties. The product was found to be little in a color change and excellent in various fastness properties such as light fastness, hot pressing fastness, steam set fastness and chlorine fastness.

EXAMPLE 11

Using a dye (0.3 part) represented by a free acid of the formula (12),

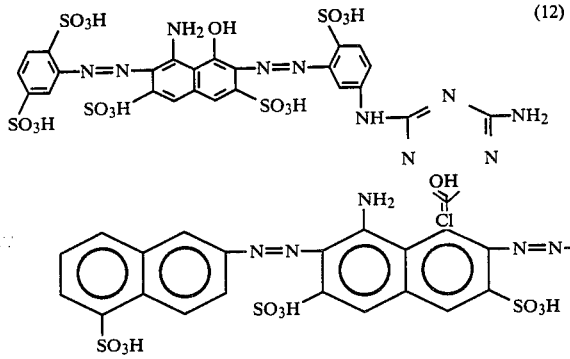

(12)

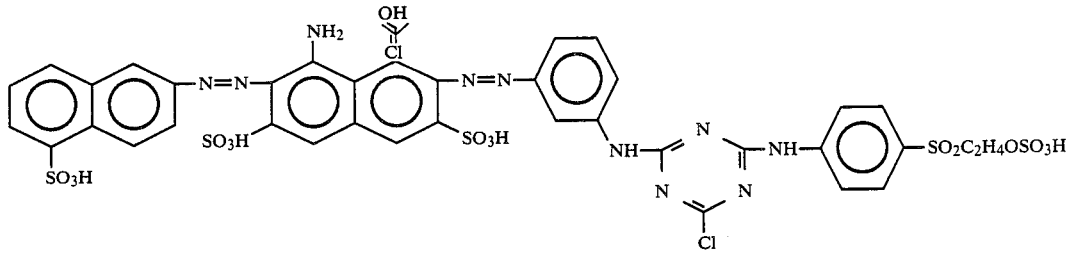

dyeing was carried out in a manner similar to that of Example 10, provided that the dyeing was carried out at 80° C. The dyed product was finished in the same manner as in Example 10, thereby obtaining a finished product of a deep blue color having excellent anticrease and shrinkproofing properties.

EXAMPLE 12

Using a dye (0.3 part) represented by a free acid of the formula (13),

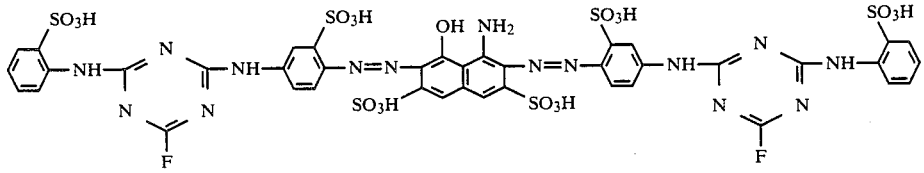

(13)

the dyeing and finishing were carried out in the same manners as those in Examples 9 and 10, respectively, thereby obtaining a dyed and finished product of a deep blue color having excellent anticrease and shrinkproofing properties.

EXAMPLE 13

Using a dye (0.3 part) represented by a free acid of the formula (14),

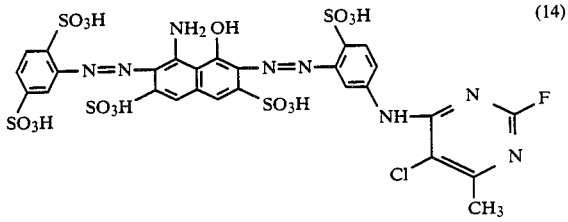

(14)

the dyeing and finishing was carried out in the same manners as those in Example 1, provided that the dyeing was carried out at 50° C., thereby obtaining a dyed and finished product of an almost unchanged deep blue color having excellent anticrease and shrinkproofing properties as well as various fastness properties.

Comparative Example 2

Using a dye represented by a free acid of the formula (15), (15)

the dyeing was carried out in the same manner as in Example 2 to obtain a dyed product of a deep blue color.

The dyed product was finished in the same manner as in Example 2. Then, the color shade turned to a reddish shade, and there was found to be markedly inferior in fastness properties such as light fastness and steam set fastness, which were excellent in case of non-finishing.

Comparative Example 3

Using C.I. Reactive Blue 184 (100 parts), the dyeing was carried out in the same manner as in Example 9, thereby obtaining a dyed product of a deep blue color excellent in various fastness properties such as light fastness, steam press fastness and hot pressing fastness.

The dyed product was finished in the same manner as in Example 9, whereby the color shade turned to a reddish shade, and the fastness properties were markedly made inferior.

What is claimed is:

1. A method for producing dyed and finished products of cellulose fiber materials, which comprises dyeing cellulose fiber materials with a dye represented by a free acid of the following formula (I),

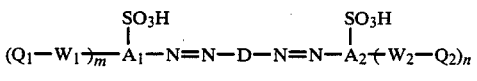

(I)

wherein each of the groups, $—W_1—Q_1$ and $—W_2—Q_2$ in the formula (I) is independently a group represented by the following formula,

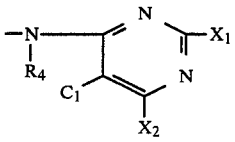

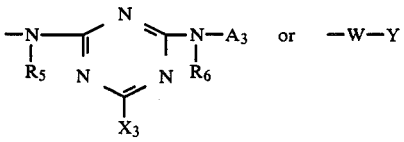

wherein $R_4$, $R_5$ and $R_6$ are independently a hydrogen atom or a lower alkyl group, $X_1$ is a fluorine or chlorine atom or a methylsulfonyl group, $X_2$ is a fluorine or chlorine atom or a methyl group, $X_3$ is a fluorine or chlorine atom, W is a direct linkage, a methylene group or a group of

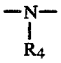

(in which $R_4$ is as defined above), Y is a group $—SO_2CH=CH_2$ or $—SO_2CH_2CH_2Z$ (in which Z is a group capable of being split by the action of an alkali), $A_3$ is a hydrogen atom, an alkyl, phenyl or naphthyl group unsubstituted or substituted, or group of $—A_4—Y$ (in which Y is as defined above and $A_4$ is a phenylene or naphthylene group unsubstituted or substituted), $A_1$ and $A_2$ are independently a phenylene or naphthylene group unsubstituted or substituted, D is a residue of 1-amino-8-naphthol mono- or di-sulfonic acid, m and n are independently 0, 1 or 2, provided that they satisfy the formula, $0<m+n\leqq 2$, and each sulfo group appended to $A_1$ and $A_2$ is located at the carbon atom adjacent to the azo group, and then finishing the dyed fiber materials with a finishing agent capable of bonding with cellulose through a bridge formation wherein the finishing agent is at least one member selected from the group consisting of N-methylol compounds, aldehyde compounds of the formula, R—CHO, in which R is a hydrogen atom or an alkyl, cycloalkyl or haloalkyl group, acetal compounds of the formula, $R'—CH(OR'')_2$, in which R' is a hydrogen atom or an alkyl, cycloalkyl or haloalkyl group, and R'' is a hydrogen atom or an alkyl group, epoxy compounds, vinyl compounds, aziridinyl compounds, polycarboxylic acid compounds, acylhalide compounds, isocyanate compounds and quaternary ammonium compounds.

2. The method according to claim 1, wherein the residue represented by D is a 1-amino-8-naphthol-3,6-di-sulfonic acid residue.

3. The method according to claim 1, wherein the dye of the formula (I) is a dye represented by a free acid of the following formula,

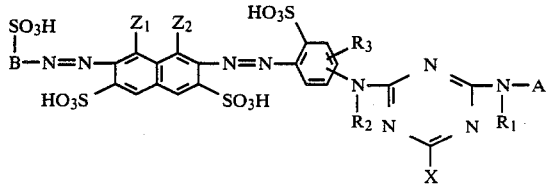

wherein A is a phenylene group unsubstituted or substituted with one or two substituents selected from methyl, ethyl, methoxy, ethoxy, chlorine, bromine and sulfo, or a naphthylene group unsubstituted or substituted with one sulfo, $R_1$ and $R_2$ are independently a hydrogen atom or a $C_1$ to $C_4$ alkyl group unsubstituted or substituted with hydroxy, cyano, alkoxy, halogen, carboxy, carbamoyl, alkoxycarbonyl, sulfo or sulfamoyl, $R_3$ is a hydrogen atom or a methyl or sulfo group, B is a phenylene or naphthylene group unsubstituted or substituted with one or two substituents selected from chlorine, bromine, fluorine, carboxy, methoxy, ethoxy, methyl, ethyl, nitro and sulfo, the sulfo group appended to B is located at the carbon atom adjacent to the azo group, any one of $Z_1$ and $Z_2$ is a hydroxy group, and the other is an amino group, X is a fluorine or chlorine atom, and Y is a group of $—SO_2CH=CH_2$ or $—SO_2CH_2CH_2Z$ (in which Z is a group capable of being split by the action of an alkali), as defined above.

4. The method according to claim 3, wherein the dye is represented by a free acid of the following formula,

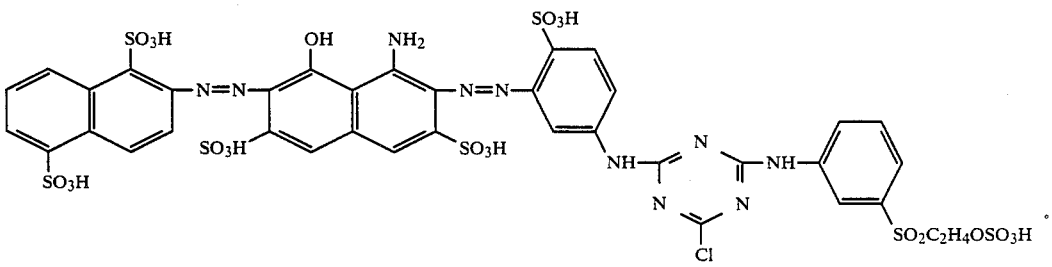

5. The method according to claim 3, wherein the dye is represented by a free acid of the following formula,

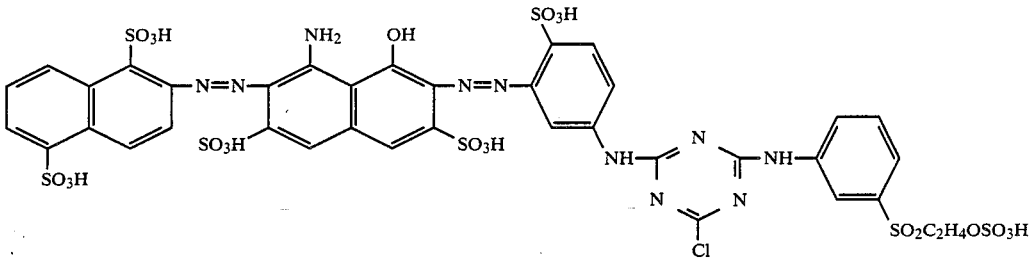

6. The method according to claim 1, wherein the N-methylol compound is dimethylolurea, methylated trimethylolmelamine, dimethylol ethyleneurea, dimethylol alkylenetriazones, methylated methyloluron, hexamethylolmelamine, dimethylol propyleneurea, dimethylol hydroxyethyleneurea, tetramethylol acetylenediurea, dimethylolated 4-methoxy-5-dimethylpropyleneurea, dimethylol alkylcarbamates or derivatives thereof.

7. Cellulose fiber materials dyed and finished by the method of claim 1.

* * * * *